US012188754B2

(12) United States Patent
Reynolds et al.

(10) Patent No.: US 12,188,754 B2
(45) Date of Patent: Jan. 7, 2025

(54) ELECTRONICALLY GENERATED/INITIATED SIGNATURE PRODUCING TRAINING CARTRIDGE

(71) Applicant: Day & Zimmermann, Inc., Philadelphia, PA (US)

(72) Inventors: Daniel D. Reynolds, Mount Pleasant, IA (US); Logan J. Brincks, Burlington, IA (US); Justin A. Wheeler, Burlington, IA (US); Jade S. Sorensen, Burlington, IA (US); Max N. Kamrath, West Burlington, IA (US)

(73) Assignee: Day & Zimmermann, Inc., Philadelphia, PA (US)

( * ) Notice: Subject to any disclaimer, the term of this patent is extended or adjusted under 35 U.S.C. 154(b) by 30 days.

(21) Appl. No.: 18/273,729

(22) PCT Filed: Jan. 21, 2022

(86) PCT No.: PCT/US2022/013270

§ 371 (c)(1),
(2) Date: Jul. 21, 2023

(87) PCT Pub. No.: WO2022/169613

PCT Pub. Date: Aug. 11, 2022

(65) Prior Publication Data

US 2024/0102777 A1 Mar. 28, 2024

Related U.S. Application Data

(60) Provisional application No. 63/140,630, filed on Jan. 22, 2021.

(51) Int. Cl.
*F42B 12/38* (2006.01)
*F42B 8/02* (2006.01)
(Continued)

(52) U.S. Cl.
CPC ..... *F42B 8/02* (2013.01); *F42B 12/382* (2013.01); *F42B 12/40* (2013.01)

(58) Field of Classification Search
CPC ..... F42B 12/365; F42B 12/382; F42B 12/42
See application file for complete search history.

(56) References Cited

U.S. PATENT DOCUMENTS 3,810,426 A * 5/1974 Baker ..... F42B 12/40 102/513
4,934,273 A * 6/1990 Endriz ..... F42B 12/42 102/336

(Continued)

FOREIGN PATENT DOCUMENTS

RU 55462 U1 8/2006

OTHER PUBLICATIONS

International Search Report and Written Opinion mailed Aug. 9, 2022 in related International Patent Application No. PCT/US2022/013270.

*Primary Examiner* — Derrick R Morgan
(74) *Attorney, Agent, or Firm* — Troutman Pepper Hamilton Sanders LLP

(57) ABSTRACT

Training ammunition that may be utilized by the U.S. Army, Marines and other Armed Forces that conduct training exercises with about 20 mm to 155 mm cartridges. The munition would electronically generate/initiated a signature that would become present at the target. The user would be able to observe the signature with the unaided eye during day or night training, or with devices such as night vision goggles/monocular or thermal sites. The generated signature would not utilize any explosives or pyrophoric iron powders, and would not create an increased fire hazard risk to the user. The munition would be able to survive typical rough (Continued)

handling and firing weapon malfunctions without becoming unusable, or causing delays in training exercises.

19 Claims, 7 Drawing Sheets

(51) Int. Cl.
*F42B 12/40* (2006.01)
*F42B 12/42* (2006.01)

(56) References Cited

U.S. PATENT DOCUMENTS 5,246,372 A * 9/1993 Campagnuolo ..... F42B 8/26 434/11
6,880,467 B1 * 4/2005 Knapp ..... F42B 12/36 102/458
7,441,505 B1 * 10/2008 Rodgers, Jr. ..... F42B 12/382 102/513
7,631,601 B2 * 12/2009 Feldman ..... F42B 12/365 102/502
7,900,619 B1 * 3/2011 Palmer ..... F42B 12/42 124/16
7,913,626 B1 * 3/2011 Reinhardt ..... F42B 12/74 102/502
8,399,817 B1 * 3/2013 Rayms-Keller ..... F42C 9/16 244/3.17
8,424,456 B2 4/2013 Broden et al.
8,848,046 B1 * 9/2014 Stofko ..... F42B 12/365 348/61
10,077,976 B2 * 9/2018 Wynn ..... F21V 23/06
10,989,508 B2 * 4/2021 Rodgers, Jr. ..... F42B 12/42
11,118,881 B2 * 9/2021 Roper ..... F42B 12/42
11,821,717 B1 * 11/2023 Rodgers, Jr. ..... F42B 12/40
2004/0099173 A1 * 5/2004 Rector ..... F42B 12/382 102/501
2005/0034627 A1 * 2/2005 Manole ..... F42B 12/382 102/513
2008/0239708 A1 * 10/2008 Bushee ..... F42B 12/36 362/112
2009/0062042 A1 * 3/2009 Huang ..... F42B 6/06 473/578
2009/0251889 A1 * 10/2009 Bushee ..... F42B 12/42 362/112
2010/0285721 A1 * 11/2010 Ma ..... F42B 8/12 446/485
2013/0291755 A1 * 11/2013 Hirlinger ..... F42B 8/12 102/513
2015/0265917 A1 * 9/2015 Chang ..... F41J 5/00 463/7
2016/0169929 A1 * 6/2016 Donahoe ..... F42B 12/362 702/149
2017/0045345 A1 * 2/2017 Román ..... F42B 12/38
2017/0336185 A1 * 11/2017 Parker ..... F42B 12/365
2018/0087883 A1 * 3/2018 Wynn ..... F21V 23/0407
2019/0093999 A1 * 3/2019 Parker ..... F42B 12/365
2019/0195604 A1 * 6/2019 Rodgers, Jr. ..... F42B 12/40

* cited by examiner

ELECTRONICALLY GENERATED/INITIATED SIGNATURE PRODUCING TRAINING CARTRIDGE

CROSS-REFERENCE TO RELATED APPLICATIONS

This application is a U.S. National Phase Entry of PCT/US2022/013270, filed on Jan. 21, 2022, which claims the benefit under 35 U.S.C. § 119(e) of Application Ser. No. 63/140,630, filed on Jan. 22, 2021, both entitled ELECTRONICALLY GENERATED/INITIATED SIGNATURE PRODUCING TRAINING CARTRIDGE, each of which is hereby incorporated by reference in its entirety.

FIELD OF DISCLOSURE

This invention relates generally to training ammunition, and more particularly, to munition that initiates a readily observable signature.

BACKGROUND ON THE INVENTION

The United States (U.S.) Army currently has three high velocity (HV) 40 millimeter (mm) grenade training round options: the M918, M385A1 (twenty two (22) M918s and ten (10) M385A1s create a Mixed Belt configuration) and the M918E1 Day/Night/Thermal (DNT) cartridge as well as two low velocity (LV) options: the M781 and the M781E1 Day/Night/Thermal (DNT).

The M918E1 and the M781E1 DNT cartridges were developed as replacements for the legacy M918/M385A1/Mixed Belt/M781 rounds. The performance specification for these rounds increased the training capability for the soldiers by eliminating potential unexploded ordnance (UXO) when a round fails to function (M918 dud) and expanding the spectrum of signature reports created upon impact. The M918E1 creates an optical signature(s) in the photopic (visual during day with the unaided eye), scotopic (visual at night with the unaided eye), Near Infrared (IR) (0.75 to 1.0 nm, this is detectable with vision devices such as, but not limited to night vision goggles or monocular), Mid-Wave IR (3.0 to 5.0 μm this is detectable with vision devices such as, but not limited to, Heavy Weapon Thermal Sites) and Long-Wave IR (8.0 to 12.0 μm this is detectable with vision devices such as, but not limited to, Heavy Weapon Thermal Sites) spectral regions. Both DNT cartridges, (M918E1 and the M781E1) utilize impact with the target to function a pyrophoric iron payload which creates a light and thermal signature report visible by the soldier.

The pyrophoric iron powder in the M918E1 is assembled into the payload in an inert nitrogen rich (oxygen free) environment. This is required, because once active, the iron powder is starved for oxygen, therefore when exposed to oxygen it very quickly corrodes (rusts) creating light and heat (visually similar to welding/grinding sparks or an Independence Day sparkler). This reaction is utilized to create the M918E1's signature report. Once reaching the target, the frangible plastic ogive/windshield and glass vial housing the pyrophoric iron shatter and disperse the powder into the air. The powder then quickly reacts, thus creating the report to the soldier without utilizing any explosives or potentially creating any UXO.

The M918E1 DNT round does have some design drawbacks. For example, since the projectile is designed to break on contact with a target, the M918E1 DNT can become damaged when mishandled by the user or when a weapon malfunction occurs, increasing the potential for undesirable training downtime. If the frangible ogive/windshield and payload become damaged enough to expose the pyrophoric iron, a reaction could occur. If a reaction were to occur, a flash and heat could be generated, which could potentially result in the Soldier becoming startled, believing a significant incident has occurred (even though it hasn't) and losing faith in their weapons systems ability, all of which are undesirable to the user community. As previously mentioned, when the pyrophoric iron reacts, heat is generated. In the case of an unintentional dispersion this creates potential burn hazards for the user, when in certain training environments, this heat may create an increased fire hazard risk both of which are undesirable to the user.

With the UXO hazards of the M918 and Mixed Belts, and the increased potential for training downtime, burns, and soldiers' loss of confidence from damaged cartridges and range fires from the M918E1, there is a need for an improved training projectile design that overcomes deficiencies of the previously developed training rounds.

SUMMARY OF THE INVENTION

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a training ammunition that may be utilized by the U.S. Army, Marines and other Armed Forces that conduct training exercises with about 20 mm-155 mm cartridges. The munition would electronically generate/initiate a signature that would become present at the target. The user would be able to observe the signature with the unaided eye during day or night training, or with devices such as night vision goggles/monocular or thermal sites. The generated signature would not utilize any explosives or pyrophoric iron powders, and would not create an increased fire hazard risk to the user. The munition would be able to survive typical rough handling and weapons malfunctions without becoming unusable, or causing delays in training exercises.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

For the purpose of illustrating the invention, the drawings show a concept of the device in a 40 mm High Velocity Grenade. It is understood that the invention is not limited to the precise arrangements/instrumentalities or caliber shown. Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
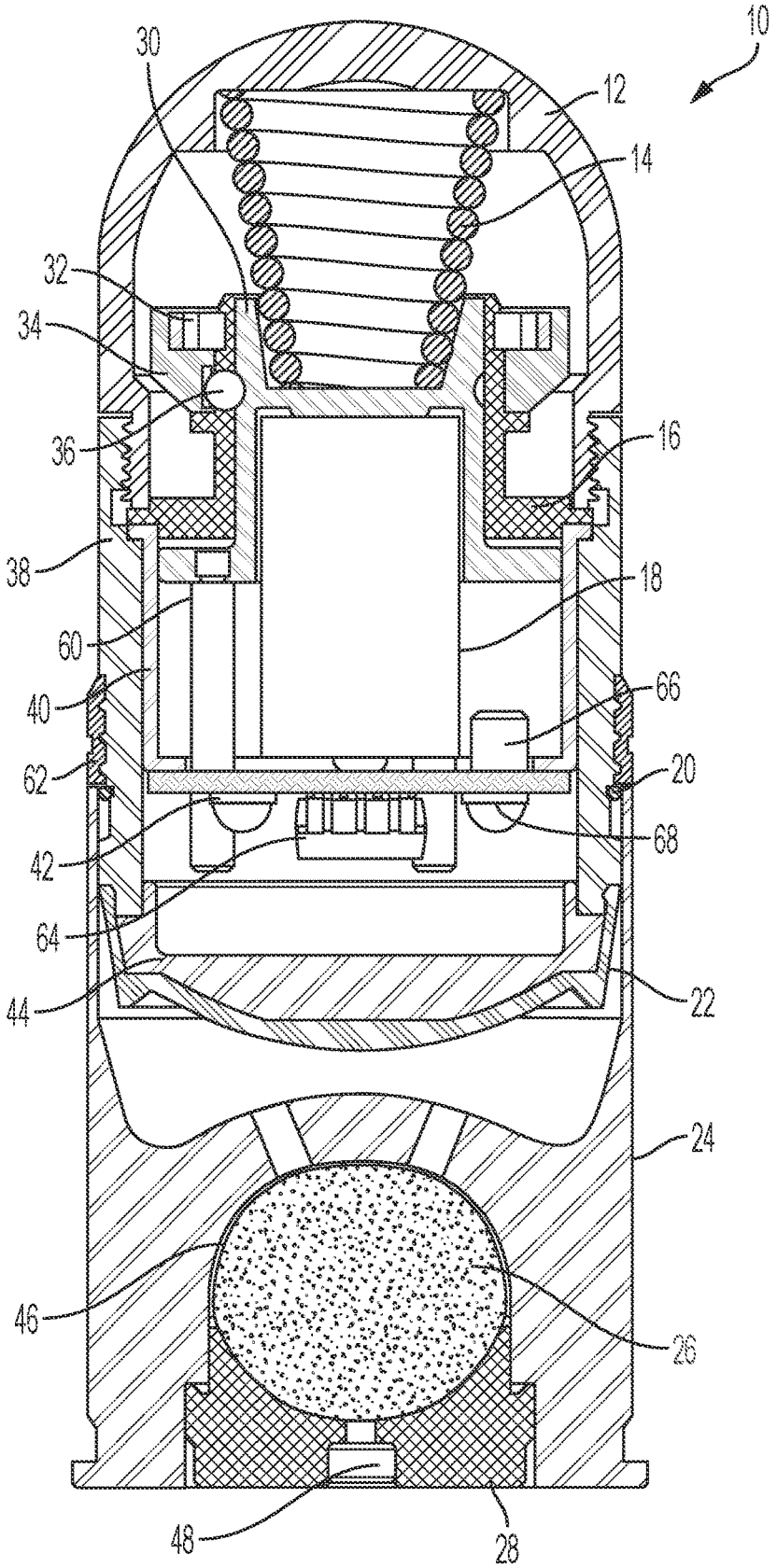
FIG. 1 is a side cross sectional view of an exemplary munition in accordance with examples of the embodiments.
Figure 2:
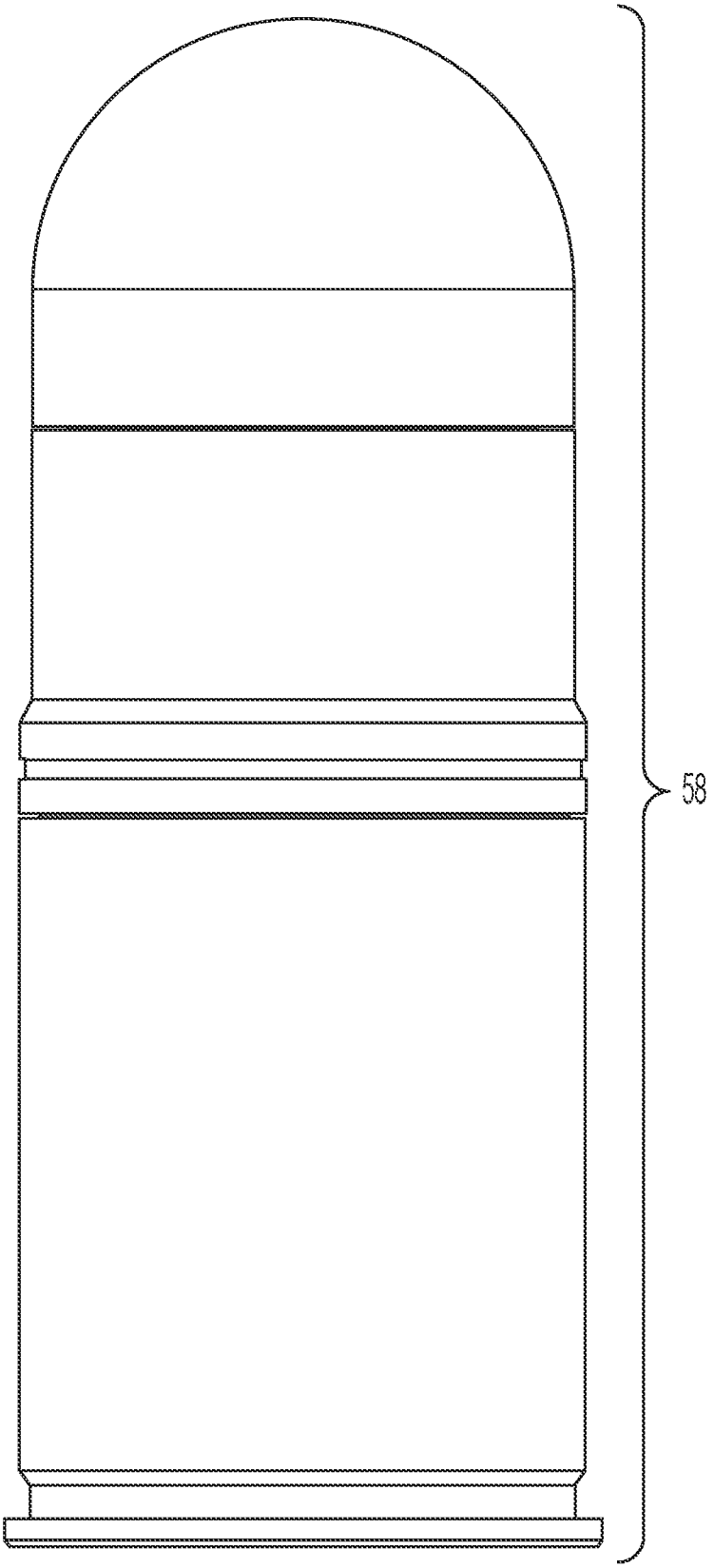
FIG. 2 is a side elevational view of the munition shown in FIG. 1.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for nonexplosive and nonpyrophoric training munitions.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Examples of the embodiments eliminate hazards of training munitions, including 40 mm high velocity M918 and M918E1 grenades, and provides a training cartridge that meets performance requirements of the training munitions (e.g., 40 MM M918E1). Aspects of the examples use electronics instead of pyrophoric iron and meet the same performance specification envelope. Exemplary cartridges will not have a frangible windshield (e.g., ogive, head cap, front cap) designed to break on contact with a target. Further, exemplary cartridges do not have the increased fire hazard risk known in current training munitions. In addition, exemplary cartridges may successfully survive mishandling and/or weapon malfunctions without damage. The term "weapon" used herein refers to a gun, launching device, or launching system from which the training munition may be fired.

In examples, training munitions are intentionally designed to survive mishandling and/or weapon malfunctions without damage, that is, without creating a hazard to a soldier, user or target (no UXO/unexploded ordnance) or potential training downtime from miss handling, weapon malfunctions, or excessive range fires. Training using the exemplary solution is designed to closely simulate existing tactical rounds such that the training will closely emulate combat situations. This training will be simulated in handling, firing, flight path and signature generation of the projectile Existing documentation discussing 30 mm and 40 mm training projectiles and cartridges includes U.S. Pat. No. 8,424,456 Non-Dud Signature Training Cartridge and Projectile. Examples of the embodiments differ from training munition discussed in existing documentation as the exemplary munitions have no frangible external components, do not utilize explosives or pyrophoric irons, do not deploy any signature material when impacting a target and use an electronically generated/initiated optical signature that may report such an impaction back to a user or observer.

Aspects of the embodiments are directed at creating an electronically generated/initiated optical signature(s) in the photopic (e.g., visual during day with the unaided eye), scotopic (e.g., visual at night with the unaided eye), Near IR (e.g., detectable with vision devices such as, but not limited to, night vision goggles or monocular), Mid-Wave IR and/or Long-Wave IR (e.g., detectable with vision devices such as, but not limited to, Heavy Weapon Thermal Sites) spectral regions with a minimal of about 0.75 and a target maximum of about 12.0 μm in a medium (e.g., including about 20 mm-50 mm) or large caliber cartridge (e.g., about 50 mm-155 mm). To generate optical signatures, LED technology may be used such as near wave IR LED's, light devices leveraging superlattice heterostructures and/or quantum cascading laser technology.

Controlled heat sources, such as resistive heating sources, tungsten wire, nichrome wire or similar technologies, may also be used to generate specifically IR signatures. These heat sources are considered "controlled" in their ability to tune temperature ranges and duration through voltage modulation while doing so inside a defined area of influence. The electronic nature of these heat sources enables them to be controlled in both the temperature output and generation duration, with a higher level of precision than the previously used pyrophoric powder. The controlled heat sources may have the ability to rapidly achieve signature temperature and rapidly return to ambient temperatures, minimizing heat transfer. This ability aids in reduction of burn hazards. The resistive heating elements, when stored and heated remain in the same position on the function control module. The previously designed alternative, pyrophoric iron, dissipated during function, leading to an unpredictability of scatter pattern and a less controlled function action.

With reference to the drawings, FIGS. 1-4, 6 and 7 depict an exemplary testing munitions 10 and 80 in accordance with specific examples of embodiments. Some exemplary testing munitions may include at least some components/subassemblies discussed below, which may include, but are not limited to, the following:

| | |
|---|---|
| 12. ogive/windshield | 14. spring |
| 16. center of gravity housing | 18. power source |
| 20. body to case seal | 22. boat tail locking mechanism |
| 24. cartridge case | 26. propellant |
| 28. base plug | 30. hammer |
| 32. mechanical release safety | 34. lock ring |
| 36. ball bearings | 38. body |
| 40. stop ring | 42. integrated function assembly |
| 44. boat tail | 46. closing cup |
| 48. primer | 50. trigger assembly |
| 52. boat tail assembly | 54. projectile assembly |
| 56. cartridge case assembly | 58. cartridge assembly |
| 60. spacer rods | 62. outer sleeve |
| 64. function control module | 66. launch detector |
| 68. signature source assembly | 70. signature |
| 72. optic enhancer | |

The components and subassemblies included in the exemplary testing munitions may be attached to other components and subassemblies thereof in accordance with the drawings and a skilled artisan. However the manner of attachment is not limited to aspects illustrated in the drawings. For example, while the drawings show the ogive/windshield 12 in threaded engagement with the body 38, it is understood that the components may be engaged by other approaches, including with friction and adhesives as desired.

The testing munition 10 includes a cartridge assembly 58 having a projectile assembly 54 and a cartridge case assembly 56. During operation, the test munition is designed to fly to the target. Upon reaching a destination, which preferably is the target, the projectile assembly 54 may provide a report back to the user who fired the projectile. The projectile assembly 54 may include a windshield 12, a spring 14, a center of gravity housing 16, a power source 18, a boat tail locking mechanism 22, a hammer 30, a mechanical release safety 32, a lock ring 34, ball bearings 36, a body 38, a stop ring 40, an integrated function assembly 42, and a boat tail 44. The cartridge case assembly 56 is utilized to propel the projectile assembly 54 to a target. The cartridge case assembly 56 may include a cartridge case 24, a closing cup 46, propellant 26 a base plug 28 and a primer 48. While not being limited to a particular theory, configuration or size, the munition 10 depicted in FIGS. 1-4 illustrate an exemplary design in a cartridge (e.g., 40 mm). Exemplary training munitions are not limited to, or required to, include only or all of the components or dimensions of the components as shown.

The windshield 12 (e.g., ogive, head cap) encloses components located in a front or head section of the munition 10. In examples, the windshield may include a hard durable material, such as aluminum or steel, and is designed to be capable of surviving weapon malfunctions, sequential rough handling tests, and other abnormal situations found during use, such as on training ranges, without becoming inoperable. The windshield 12 may also allow for a signature created inside of the projectile assembly 54 to be visible.

The spring 14 (e.g., compression spring) may provide a stored energy source to initiate a trigger assembly 50. When the projectile assembly 54 reaches the target, impact against the target, forces the lock ring 34 to continue traveling into the ogive 12, enabling the ball bearing 36 to release away from the center of gravity housing 16 which releases the spring 14 to push the hammer 30 away from the windshield 12. It is understood that the term "spring" may refer to any device (e.g., mechanical, electrical, chemical) other than explosives that upon release urges the hammer away from the front windshield 12. The term "spring" may include any device, mechanical, electrical or non-explosive/non-pyrophoric chemical that upon release urges the hammer away from the front windshield 12. Upon impact, the lock ring 34, slides towards the front of the windshield 12, enabling the ball bearings 36 to travel laterally away from the grooves in the hammer 30. The spring 14 is then unobstructed, enabling the hammer to travel freely. In an airburst configuration, the lock ring 34 may be mechanically or electrically moved in flight to enable the same release sequence.

The center of gravity housing 16 may establish the appropriate overall projectile weight and center of gravity to replicate a ballistic simulant to an equivalent tactical round. The center of gravity housing 16 may also be utilized to help hold other components, such as the spring 14, power source 18, hammer 30, mechanical release safety 32, lock ring 34, ball bearings 36, and/or the integrated function assembly 42 prior to impact.

Figure 4:
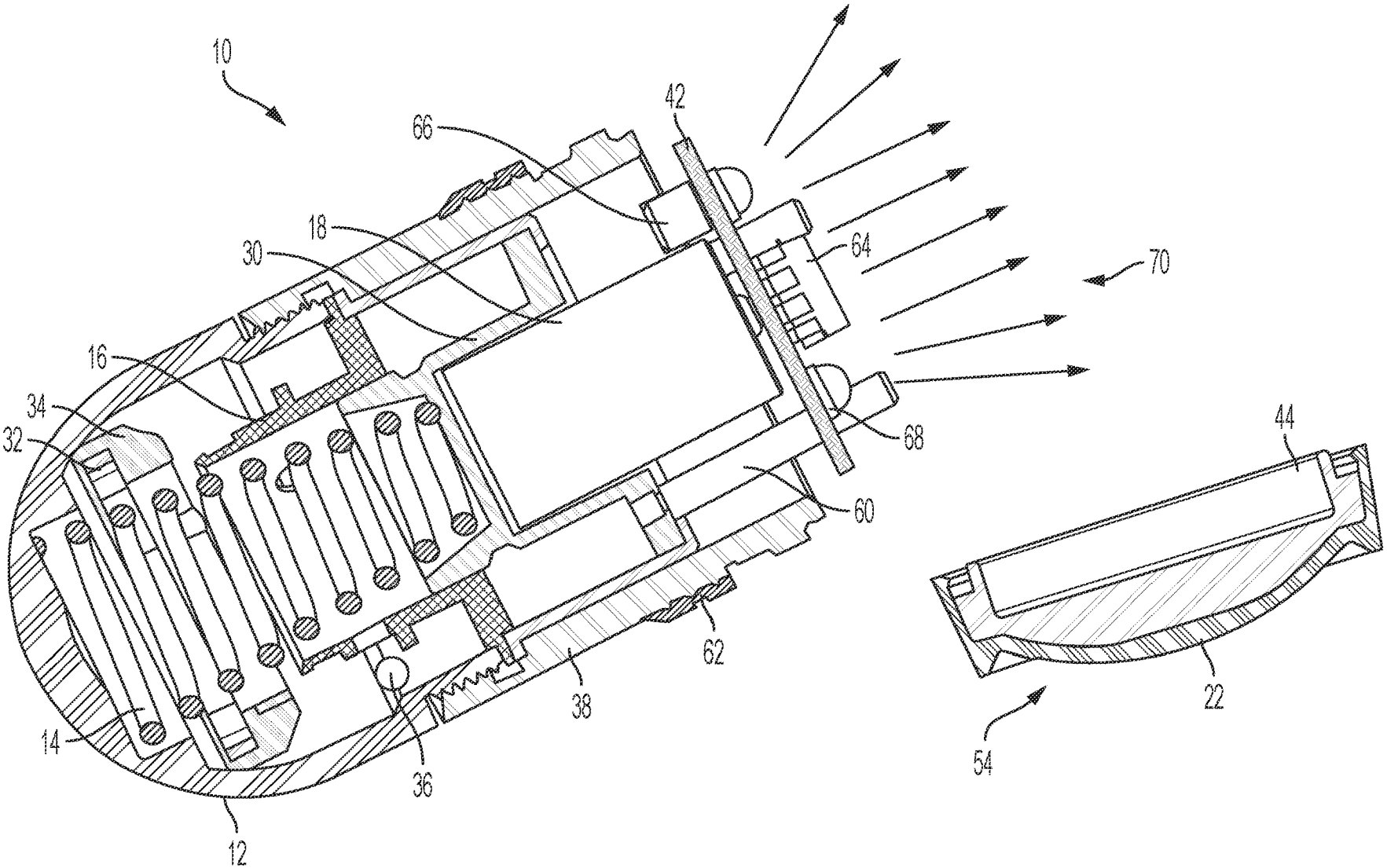
FIG. 4 is a side cut view of the munition shown in FIG. 1 functioning upon impact

The hammer 30 may be located inside the center of gravity housing 16. The hammer 30 may be held in place until the projectile assembly 54 reaches the impact target by one or more ball bearings 36 or other devices (e.g., holding pins). Upon reaching the target the hammer 30, once released from the ball bearings 36, may be propelled toward the back of the projectile assembly 54 by the spring 14. Components of the munition 10 may be attached to the hammer 30, including the integrated function assembly 42 that may also be activated by the hammer's 30 propelled movement. For example, FIGS. 1 and 4 show the hammer 30 including or attached to spacer rods 60 that extend backwards and substantially parallel to the longitudinal axis away from the windshield and through the stop ring 40 to attach to the integrated function assembly 42.

The mechanical release safety 32 is a safety device of mechanical or other such nature that prevents the trigger assembly 50 from triggering to function prematurely by holding a lock ring 34 in place until the projectile assembly 54 is fired from the cartridge case assembly 56. Upon such firing, the projectile assembly 54 is separated from the cartridge case assembly 56 as discussed in greater detail below, and undergoes a safety release triggering action, such as movement from a set-back force or a spin rotation. In certain examples, the mechanical release safety 32 may be a spin lock that undergoes the triggering action during flight due to a desired spinning rotation along the longitudinal axis of the projectile that releases the safety.

A lock ring 34 may hold the ball bearings 36 engaged with the hammer 30 until the projectile assembly 54 impacts the target. Upon impact with the target, the lock ring 34 may move forward, which releases the ball bearings 36 and allows the spring 14 to expand and push the hammer 30 toward the back of the projectile assembly 54.

Referring to FIG. 1, ball bearings 36 may be located between the lock ring 34 and the hammer 30 and inside the center of gravity housing 16. The ball bearings 36 help to hold the hammer 30 in a locked position until the projectile assembly 54 impacts the target.

The power source 18 is designed to generate or provide the electrical needs of the training munition 10. Exemplary power sources 18 may include setback generator(s), DC generator(s) including both potential and captured energy, batteries, thermal generation, and wireless transfer while in or exciting the muzzle of a weapon that fires the munition 10.

The body 38 is a central housing of the munition 10 that in FIG. 1 is shown attached to the windshield 12 on a front end of the body, and attached to the cartridge case 24 at a back end of the body. Both attachments may be held by friction, and the frictional attachment between the body 38 and the windshield may be by threaded engagement there between. The body 38 may be primarily made of a hard durable material, such as aluminum or steel (e.g., 12L14), that is specifically designed to survive weapon malfunctions, sequential rough handling tests and other abnormal situations found during use, such as on training ranges without becoming inoperable. As can be seen in FIGS. 1 and 4, the body 38 is designed to house at least the center of gravity housing 16, hammer 30 and stop ring 40 before and during use.

Figure 3:
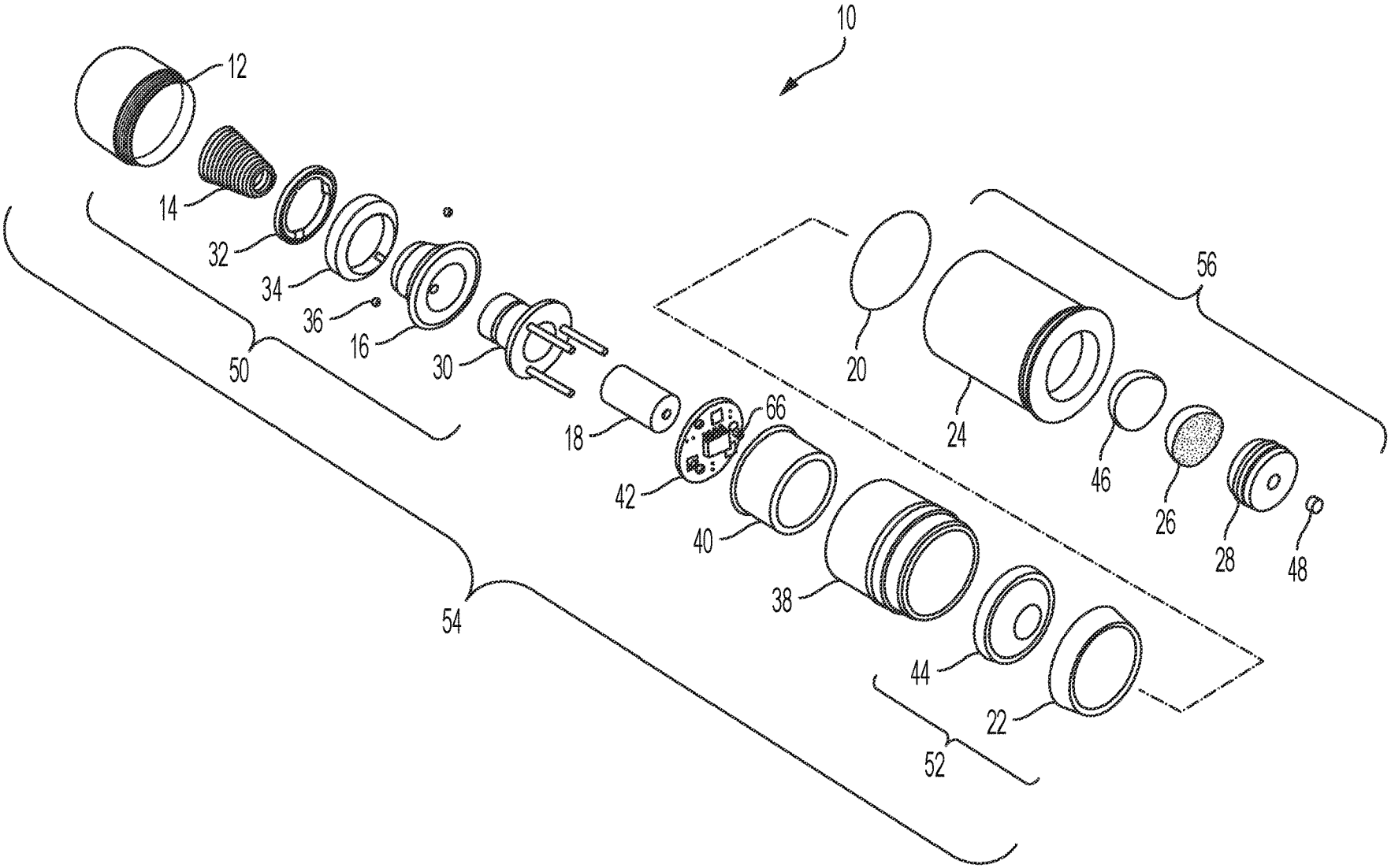
FIG. 3 is an exploded isometric view of the munition shown in FIG. 1.

The stop ring 40 is designed to limit the travel distance of the hammer 30 being urged by the spring 14, and before use may abut the integrated function assembly 42. As can be seen in FIGS. 1, 3 and 4, the stop ring 40 is generally sleeve shaped with a front shoulder extended radially outwards to seat against an inward extending shoulder of the body 38. The stop ring 40 also includes a rear shoulder extending radially inwards to act as a stop to the hammer 30 longitudinal shifting away from the windshield 12 upon munition 10 impact with a target.

In examples the body to case seal 20 may be an o-ring configured to create a seal between the projectile assembly 54 and the cartridge case assembly 56 sufficient to prevent fluid or gas leakage into the cartridge case 24 during normal handling operations prior to operational use. The seal 20 o-ring may be resilient (e.g., rubber, plastic, silicon) or hard (e.g., metal, steel, aluminum) as needed in view of allowable engineering tolerances understood by a skilled artisan. In certain examples an outer sleeve 62 may be threaded or otherwise movable about the body 38 to help secure the seal 20 between the body 38 and the cartridge case 24 and aid in flight stability as readily understood by a skilled artisan.

As can be seen in FIG. 1, the cartridge case 24 may be a hard durable (e.g., steel, aluminum, metal) unit mounted to the aft (back) end of the projectile assembly 54 that houses the closing cup 46, propellant 26, base plug 28 and primer 48. The cartridge case 24 may include vent holes for the propellant as well understood by a skilled artisan. A base plug 28 may be placed in the cartridge case 24, encapsulating the closing cup 46 and propellant 26. The base plug 28 may also hold the primer 48.

The cartridge case assembly 58 may include a closing cup 46 installed inside of the cartridge case 24 to hold the propellant 26 from prematurely escaping through the vent holes located in cartridge case 24. As can best be seen in FIG. 1, propellant 26 may be place inside the closing cup 46 inside the cartridge case 24. During firing of the training munition 10 from a gun, a primer 48 would be detonated, which ignites the propellant 26 and pushes the projectile assembly 54 from the cartridge case assembly 56 and out the gun barrel. The primer 48 is shown in FIG. 1 inserted into the base plug 28 and designed to be the beginning of the firing train. Located on the aft (back) end of the cartridge case 24, inside of the base plug 28, the primer 48, when functioned, may ignite the propellant 26 and propel the projectile assembly 54 to its intended target.

The integrated function assembly 42 may include a function control module 64, a launch detector 66, and a signature source assembly 68 that in combination may detect when the projectile assembly 54 launches, reaches and/or impacts the intended target, and activates the signature source(s). The function control module 64 is a control unit that may have an electrical design, for example having a printed circuit board with components such as microcontrollers or integrated circuits. In certain examples the function control module 64 may have an electro-mechanical design using an impact detecting device to complete a circuit or activate a switch. The function control module 64 may also include common electrical components such as diodes, capacitors, inductors and/or resistors, as understood by a skilled artisan.

The function control module 64 may accept a programmable signal, that may indicate that the projectile reached a target during flight and allow the training munition 10 to simulate an air-burst function of other tactical rounds. The function control module 64 may receive the programmable signal from a communication signal, such as an infrared communication, radio frequency transmission or other wireless communication signal as readily understood by a skilled artisan. The programmable signal may be generated from stand-alone data transmitters or integrated weapon systems. During an air-burst function, an impact detection mechanism (e.g., release safety 34) may be electronically initiated in flight. After the air-burst initiation, the mechanical safety release 34 will be pushed or pulled further into the windshield 12, enabling the previously described chain of actions to execute including the signal source assembly 68 transmitting the signature back to the user while the projectile is in flight. The air-burst function activation may be determined by time, revolutions, velocity or other approaches as understood by a skilled artisan. The function control module 64 may also activate the signature source assembly 68 while the projectile assembly 54 is in flight, and create a tracer effect via the lighted projectile travelling in flight. The tracer function of the training munition 10 may remain on from firing to target impact or may pulse intermittently as desired.

The launch detector 66 of the integrated function assembly 42 may include a setback pin and spring in conjunction with mechanical and/or electronic components to enable functionality of the integrated function assembly 42 upon setback/launch of the training munition 10. Setback refers to action and forces the projectile experiences while being fired from a gun The setback pin is designed to mechanically detect setback and complete or break an electronic switch to initiate operations of the function control module 64. This launch detection may also be accomplished utilizing alternative electronic switches or sensors such as vibration sensors, lucy switches or other similar components, as readily understood by a skilled artisan.

In certain examples, the training munition 10 may also trigger electronic functions inside the projectile by a separation of the function control module 64, from a conductive surface, like the trigger assembly 50. For example, a function control module 64 electronic switch may include a conductor or electrode attached to the circuit board of the integrated function assembly 42 on a front side towards the windshield 12 between the circuit board and the stop ring 40, which may also be conductive and part of the electronic switch circuit. Upon activation of the trigger assembly 50 and release of the spring 14, the hammer 30 urges the integrated function assembly 42 away from the stop ring 40. This separation breaks the circuit previously completed via the conductive attachment between the conductor and the stop ring 40, which initiates other electronic actions including the illumination of the signature 70 (FIG. 4) by the assembly 68. This approach allows for activating different electronic functions or stages from physical separation of components, and may be used in multi-staged electronic sequences to easily detect separation and respond to the projectile events. It is understood that other sensors besides the conductive connection may be used in lieu of the separation approach, for example a shock sensor attached to the function control module 64 to sense an initiating operation of the trigger assembly and activate illumination of the signature 70.

The signature source assembly 68 is designed to create a signature 70 (FIG. 4) in the photopic (visual during day with unaided eye), scotopic (visual at night with unaided eye), Near IR (detectable with vision devices such as night vision goggles or monocular), Mid-Wave IR and/or Long-Wave IR (detectable with vision devices such as Heavy Weapon Thermal Sites) spectral regions with a minimal wavelength of about 0.75 μm and a target maximum of about 34.0 μm and without creating an increased fire hazard. The light and/or heat signatures may be created using, for example, LED(s), resistive heating elements such as nickel chromium (NiCr), tungsten filament(s), flash tube(s), inductive heating element(s), electronically triggered chemical signatures, thermal radiation, lasers, or any combination thereof as understood by a skilled artisan.

Exemplary munitions 10 may include an optic enhancer to make the signatures 70 created by the signature source assembly 68 meet desired detectability requirements. Optic enhancers may include, for example, heated byproduct from visible light, lens(es), emissivity enhancement element(s), non-linear crystals, fiber optics and reflectors. In certain examples, light signatures 70 generated from the signature source assembly 68 may be transmitted through optic enhancers and detectable through the body 38.

The boat tail locking mechanism 22 may be a hard durable (e.g., aluminum, steel) internal cap designed to hold the boat tail 44 to the body 38 during launch and flight. While not being limited to a particular theory, the boat tail locking mechanism may release at target impact.

A boat tail 44 may be installed in the aft (back) of the body 38 and may be held in place by the boat tail locking mechanism 22. The boat tail 44 and boat tail locking mechanism may discard from the projectile assembly 54 upon reaching the target and expose the signature for detection. The boat tail 44 may be a durable material (e.g., steel, aluminum, transparent or translucent plastic). In certain example a clear boat tail may allow a signature to transmit though it.

Referring to FIG. 3, a trigger assembly 50 may be a mechanical assembly encompassed inside or as part of the projectile assembly 54. The trigger assembly 50 may include the spring 14, center of gravity housing 16, hammer 30, mechanical release safety 32, lock ring 34, and the ball bearings 36. The trigger assembly 50 may interface with other components such as any combination of the power source 18, integrated function assembly 42, and boat tail assembly 52. The trigger assembly 50 may operate after projectile setback and upon reaching the intended target. The trigger assembly 50 may also initiate electronic functions in components such as the function control module 64. Upon munition 10 impact after firing, the trigger assembly 50 may aid in removal of the boat tail assembly 52 and/or move the signature and supporting signature components towards the rear of the body 38 for increased signature visibility.

The boat tail 44 and boat tail locking mechanism 22 may together form a Boat Tail Assembly 52 configured to expose the signature source assembly 68 and aid in visibility of a signature(s) 70. The boat tail assembly 52 may separate from the body 38 when reaching the intended target or during flight. It should be noted that the boat tail assembly may not include both the boat tail and the boat tail locking mechanism. In specific examples, the boat tail assembly 52 may include the boat tail locking mechanism as a rigid shell of aluminum, steel, plastic or a similar material, the boat tail 44 as a transparent or semitransparent material that allows the signature to be viewed through this assembly, or a combination of these structural components.

In operation, the cartridge assembly 58 is loaded into a weapon (e.g., gun, munition launcher) and fired. The weapon initiates the primer 48, which ignites the propellant 26. The propellant 26 ejects the projectile assembly 54 from the cartridge case assembly 56 and through the weapon barrel to the target. While the target is an intended target, it is understood that the target may also be an unintended target reached by the fired projectile assembly 54. As the projectile assembly 54 is propelled, the launch detector 66 may initiate electronic functions of the function control module 64 discussed above. As the projectile assembly 54 leaves the cartridge case assembly 56, travels through the gun barrel and exits the weapon, the power source 18 generates, receives and/or releases stored energy to activate the function control module 64. The power source 18 may generate power internally by converting stored mechanical energy in devices like spring 14 into electric energy. Other power generation approaches may be used in parallel with or as a replacement for the battery. The power source may include devices such as setback power generators or chemical reactions that may aid in power supply to the function control module 64.

Once the projectile assembly 54 reaches the intended target, whether that be a programmed target or a hard target, the mechanical release safety 32 releases and/or activates a progression of mechanical and/or electric sequences. The function control module 64 detects the target has been reached. The function control module 64 may also allow the trigger assembly 50 to aid in target detection. Upon detecting a reached target, the function control module 64 will activate the signature source assembly 68. The trigger assembly 50, may eject the boat tail assembly 52 from the projectile assembly 54 as can be seen in FIG. 4, and may also push the integrated function assembly 42, possibly with an optics enhancer, towards and maybe out of the rear of the projectile assembly 54.

The signature source assembly 68 illuminates a signature 70. The signatures created by the signature source assembly 68 may then transfer through any optic enhancer, if present, to create desired spectral regions. The signatures 70 will thus be identifiable from the projectile assembly 54 to a user, and may remain present for a temporary time (e.g., less than one minute, less than 30 seconds, a few seconds). As noted above, the signatures reported back to the user may include optical signature(s) in the photopic (visual during day with unaided eye), scotopic (visual at night with unaided eye), Near IR (detectable with vision devices such as, but not limited to, night vision goggles or monocular), Mid-Wave IR and/or Long-Wave IR (detectable with vision devices such as, but not limited to, heavy weapon thermal sites) spectral regions with an estimated wavelength range of about 0.75 μm (target minimum) to about 12.0 μm (target maximum). After the cartridge assembly 58 is fired and the projectile assembly 54 reaches the target, all components of the cartridge assembly 58 are considered spent, and are therefore not reusable.

Figure 5:
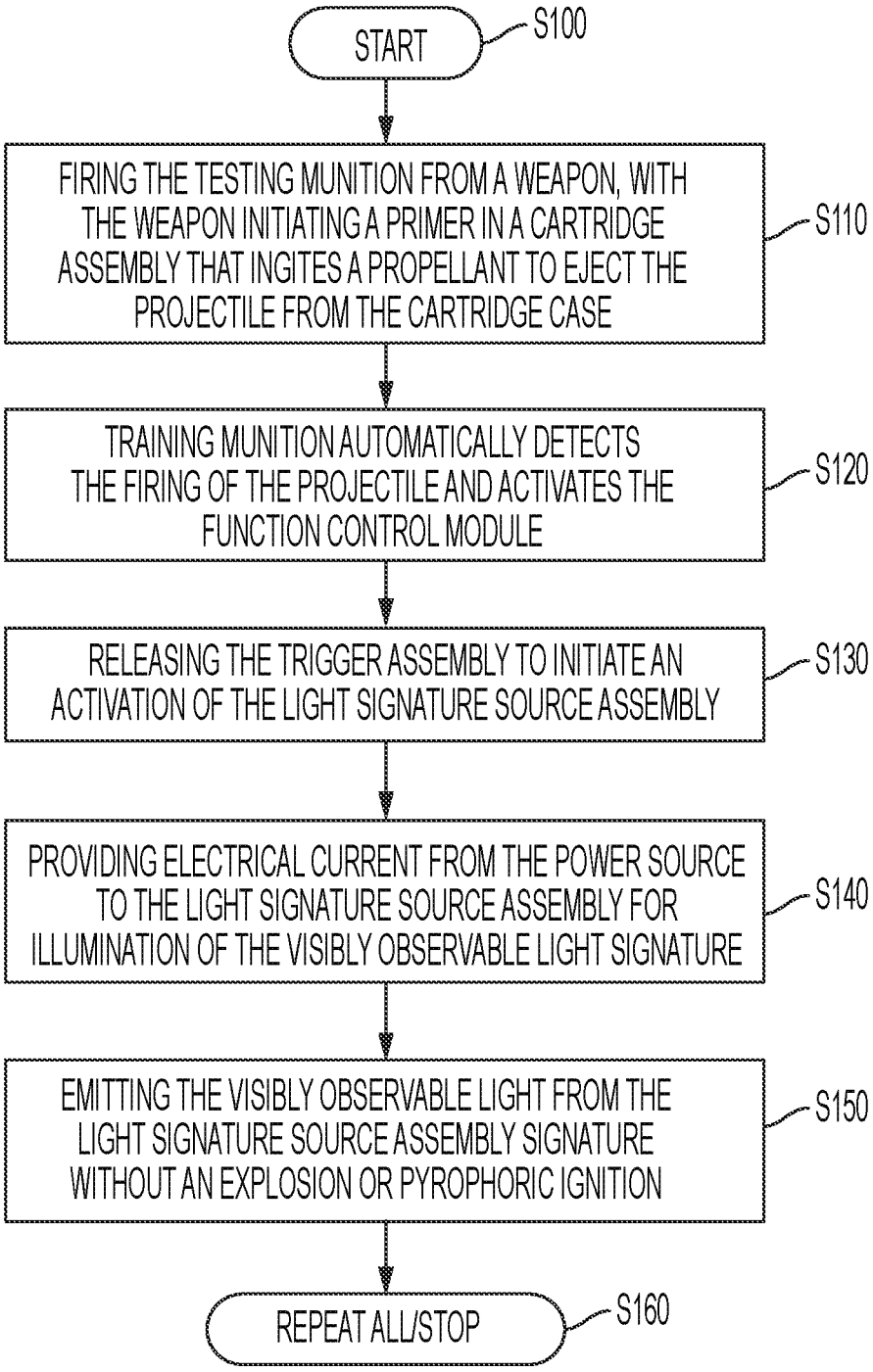
FIG. 5 is a flowchart depicting the operation of an exemplary method of automatically generating a visibly observable signature without an explosive signature from a training munition in accordance with an example of the embodiments.

The disclosed embodiments may include an exemplary method for automatically generating a visibly observable signature without an explosive signature from a training munition. FIG. 5 illustrates a flowchart of such an exemplary method. As shown in FIG. 5, operation of the method commences at Step S100 and proceeds to Step S110. At Step S110, the testing munition with a cartridge assembly is loaded into a weapon (e.g., gun, munition launcher) and fired. The weapon initiates the primer, which ignites the propellant. The propellant ejects the projectile assembly from the cartridge case assembly and through the weapon barrel to the target. While the target is an intended target, it is understood that the target may also be an unintended target reached by the fired projectile assembly.

Operation of the method proceeds to Step S120, where the training munition automatically detects the firing of the projectile and activates its function control module. In examples, the launch detector may initiate electronic functions of the function control module 64, which receives power from the power source for activation thereof. Operation of the method proceeds to Step S130, where a safety release of a lock ring holding the trigger assembly in a position of potential energy is automatically triggered. When the projectile reaches the target, the trigger assembly releases the potential energy and initiating an activation of the signature source assembly.

Operation of the method proceeds to Step S140, where the power source provides electrical current to the signature source assembly for illumination of the visibly observable and IR signatures. At Step S150, the signature source assembly emits the visibly observable signature and IR signature without a pyrophoric ignition. The signature sources may be located within the projectile outer shell, or may be urged by the trigger assembly beyond the projectile outer shell. Operation may cease at Step S160.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 5 and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Figure 6:
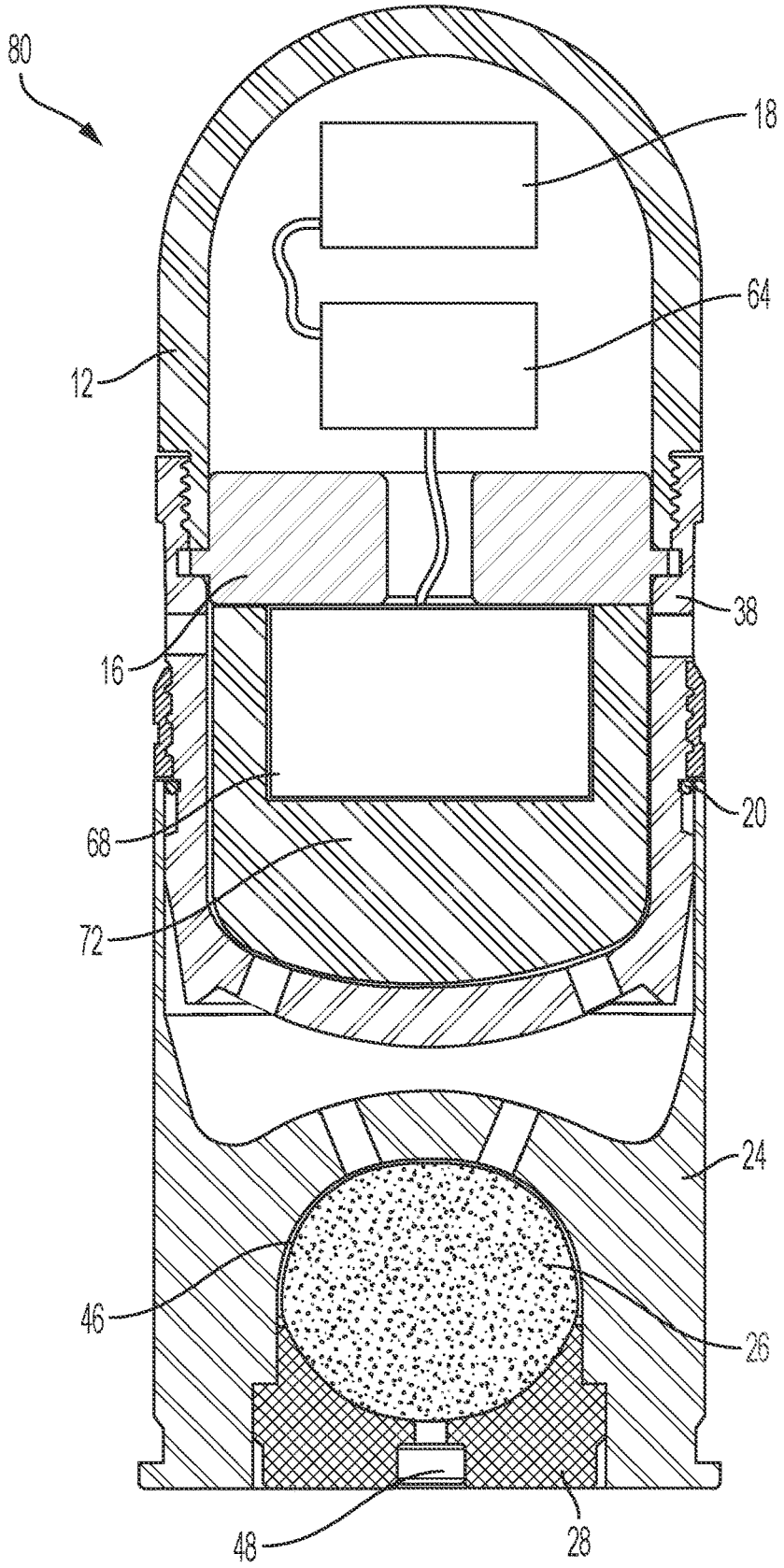
FIG. 6 is a side cross sectional view of another exemplary munition in accordance with examples of the embodiments.
Figure 7:
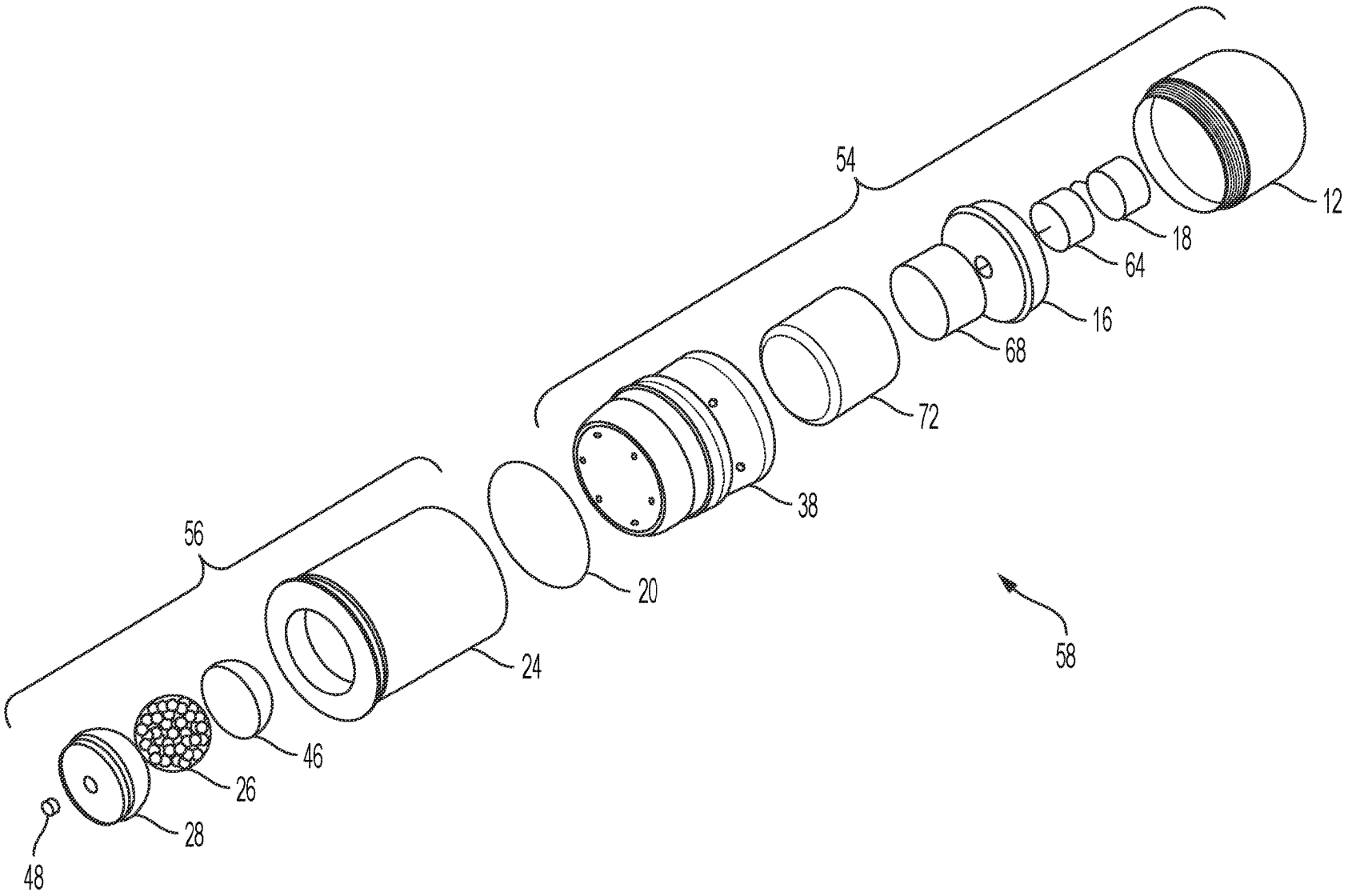
FIG. 7 is an exploded isometric view of the munition shown in FIG. 6.

FIGS. 6 and 7 depict another exemplary testing munition 80 in cross-sectional view and exploded view, respectively, for automatically generating a visibly observable signature without an explosive or pyrophoric signature from a training munition in accordance with specific examples of embodiments. Like referenced numerals designate similar or identical elements as discussed above and may be discussed in brevity to avoid unnecessary redundancy.

Cartridge assembly 58 may include the projectile assembly 54 and the cartridge case assembly 56. Upon functioning the cartridge case assembly 56, the projectile assembly 54 will fly to the target, upon reaching the target the projectile assembly 54 will provide a non-explosive signature to the user of function. The projectile assembly 54 may include a windshield 12, a power source 18, a function control module 64, a center of gravity mass 16, signature source(s) 68 and optic enhancer(s) 72. A cartridge case assembly 56, utilized to propel the projectile assembly 54 to a target may include, but is not limited to, a cartridge case 24, a closing cup 46, a propellant 26, a base plug 28 and a primer 48. While not being limited to a particular theory, configuration or size, examples depicted in FIGS. 6 and 7 illustrate the conceptual design in a 40 mm cartridge. Exemplary training munitions in embodiments are not limited to, or required to, include only or all of the components or dimensions of the components as shown.

The windshield 12 may be made of or include a material, such as aluminum, and is expected to be capable of surviving weapon malfunctions, sequential rough handling tests, and other abnormal situations commonly found on training ranges without becoming inoperable. The windshield 12 shown in FIGS. 6 and 7 may also be designed to allow for the signature created inside of the projectile assembly to be visible.

As discussed above, the function control module 64 may detect when the projectile reaches and/or impacts the intended target, activating the signature source(s). The function control module 64 may be of electrical nature, utilizing components such as microcontrollers or integrated circuits, or of a mechanical design using an impact detecting device to complete a circuit or activate a switch. The function control module 64 may be modified to accept a programmable signal, that, if utilized would allow the training round to simulate the air-burst function of other tactical rounds. The air-burst function activation may be determined by time, revolutions, velocity or other a. The function control approaches as understood by a skilled artisan. The module 64 may also be modified to activate a signature source while in flight, to thus create a tracer effect. The tracer function of the round could remain on from firing to target or pulse intermittently.

The center of gravity mass 16 or housing may create the appropriate overall projectile weight and center of gravity to create a ballistic simulant to the equivalent tactical rounds. The center of gravity mass 16 may also be utilized as a housing to help hold other components, such as the power source 18, function control module 64, signature sources 68 and/or optic enhancer(s) 72 in place as needed.

The signature source(s) 68 may create optical signature(s) in both the visible and IR regions as discussed in greater detail above. This signature(s) may be created utilizing LED(s), Resistive heating elements, such as, but not limited to, nickel chromium (NiCr), flash tube(s), inductive heating element(s), electronically triggered chemical signature, thermal radiation, or any combination of the fore mentioned items or other similar manor as readily understood by a skilled artisan.

Optic enhancer(s) 72 may help, if needed, to make the signatures created by signature source(s) 68 meet the detectability requirements. Potential optic enhancers include, but are not limited to, heated byproduct from visible light, lens(es), emissivity enhancement element(s), non-linear crystals, fiber optics and reflectors. The signature(s) generated from signature source(s) 68, and transmitted through optic enhancer(s) 72, as needed, may be detectable through the body assembly 38.

In operation, the cartridge will be loaded into a weapon system and fired. The weapon system will initiate the primer 48, which will ignite the propellant 26. The propellant 26 will push the projectile assembly 54 from the cartridge case assembly 56, through the gun barrel of the weapon system and to the target. As the projectile assembly 54 leaves the cartridge case assembly 56, travels through the gun barrel and exits, the power source 18, will generate, receive or release stored energy to activate the function control module 64. Once the projectile assembly 54 reaches the intended target, whether that be a programmed target or a hard target, the function control module 64 will detect the target has been reached. The function control module 64 will then activate the signature source(s) 68. The signatures created will be, if needed, then transferred through an optic enhancer(s) 72 to create all desired spectral regions.

The signatures will be present from the projectile assembly 54 to the user, and may remain present for a temporary time (e.g., less than one minute, less than 30 seconds, a few seconds). In examples, the signatures reported back to the user may include optical signature(s) in the photopic (visual during day with unaided eye), scotopic (visual at night with unaided eye), Near IR (this is detectable with vision devices such as, but not limited to, night vision goggles or monocular), Mid-Wave IR and/or Long-Wave IR (these are detectable with vision devices such as, but not limited to, heavy weapon thermal sites) spectral regions with an estimated wavelength range of about 0.75 μm (target minimum) to about 12.0 μm (target maximum). After the cartridge assembly 58 is fired and the projectile assembly 54 reaches the target, all components of the cartridge assembly 58 are considered spent, and are therefore not reusable.

It should be noted that the electronically generated signature is also referred to herein as a light/heat signature because the electronically generated signature may provide some controlled heat. This heat is substantially safer and poses far decreased burn hazards than conventional training munitions. In addition, the training munitions described by examples herein do not have an exposed heating element should the training munition become lodged inside the barrel of a weapon. Previous designs, when lodged inside the barrel could release hazardous powder causing a burn risk. However, if an exemplary training munition does not function as desired, any electronic element would remain inside the body 38 of the munition and provide minimal to no burn hazard on recovery.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A nonexplosive training munition, comprising:

a projectile configured to be propelled towards a target, the projectile having a projectile outer shell that has an aperture;

a signature source assembly attached to the projectile outer shell adjacent to the projectile outer shell aperture, the signature source assembly configured to illuminate an observable signature without an explosive signature;

a trigger assembly housed with the projectile outer shell and in communication with the signature source assembly to initiate an activation of the signature source assembly upon the projectile reaching the target; and a boat tail assembly that, in a first position, covers the projectile outer shell aperture and encloses the trigger assembly and signature source assembly within the projectile outer shell, wherein the boat tail assembly is urged by the trigger assembly during the initiation to a second position separate from the projectile outer shell to enable observable exposure of the observable signature, wherein the signature source assembly upon the activation produces the observable signature without a pyrophoric ignition.

2. The nonexplosive training munition of claim 1, further comprising a power source housed by the projectile outer shell, the power source providing electrical current to the signature source assembly for production of the observable signature.

3. The nonexplosive training munition of claim 1, further comprising a function control module in communication with the signature source assembly, the function control module configured to detect when the projectile reaches the target and activate the signature source assembly.

4. The nonexplosive training munition of claim 3, further comprising a launch detector having a sensor configured to detect a firing of the projectile and activate the function control module, the sensor further configured to detect a setback motion within the projectile outer shell upon launching of the projectile and modify an electrical state of an electrical circuit conductively coupled to the function control module to activate the function control module.

5. The nonexplosive training munition of claim 3, further comprising a stop ring within the projectile outer shell that is configured to limit movement of the trigger assembly upon initiation, the function control module conductively coupled to the stop ring and urged by the movement of the trigger assembly upon initiation to break conductivity with the stop ring and activate the signature source assembly.

6. The nonexplosive training munition of claim 1, the signature source assembly including at least one of a LED and a controlled heat source, the one of the LED and the controlled heat source providing the observable signature in at least one of visible, Near IR, a Mid-Wave IR and a Long-Wave IR spectral region.

7. The nonexplosive training munition of claim 1, wherein the signature source assembly is located at a third position within the projectile outer shell prior to the activation, and is urged by the trigger assembly during the initiation to a fourth position beyond the projectile outer shell.

8. The nonexplosive training munition of claim 1, wherein the projectile outer shell aperture is at a back end of the projectile outer shell.

9. The nonexplosive training munition of claim 1, further comprising a cartridge case assembly including a cartridge case frictionally coupled to the projectile outer shell, the cartridge case assembly further including a propellant configured to propel the projectile to the target.

10. A method of automatically generating a visibly observable signature without an explosive signature from a training munition, the training munition including a projectile configured to be propelled towards a target, the projectile having a projectile outer shell, a signature source assembly attached to the projectile outer shell, the signature source assembly configured to illuminate a visibly observable signature without an explosive signature, and a trigger assembly housed with the projectile outer shell and in communication with the signature source assembly to initiate an activation of the signature source assembly upon the projectile reaching the target, wherein the signature source assembly upon the activation produces the visibly observable signature without a pyrophoric ignition, the method comprising:

a) upon a firing of the projectile, triggering a safety release of a lock ring holding the trigger assembly in a position of potential energy;

b) upon the projectile reaching the target, releasing the potential energy and initiating the activation of the signature source assembly, wherein upon releasing the potential energy, the trigger assembly moves a boat tail assembly from a first position to a second position separate from the projectile outer shell to enable observable exposure of the visibly observable signature; and c) emitting the visibly observable signature without a pyrophoric ignition.

11. The method of claim 10, further comprising, after Step b) providing electrical current to the signature source assembly for illumination of the observable signature.

12. The method of claim 10, further comprising, at Step a), detecting the firing of the projectile and activating a function control module.

13. The method of claim 12, the detecting the firing of the projectile including detecting a setback motion within the projectile outer shell with a setback pin upon the firing of the projectile and the activating the function control module including modifying an electrical state of an electrical circuit conductively coupled to the function control module.

14. The method of claim 12, the Step b) further comprising upon the projectile reaching the target, releasing the potential energy to urge the function control module away from a conductive coupling with a stop ring within the projectile outer shell and break the conductive coupling to activate the signature source assembly.

15. The method of claim 10, the Step c) further comprising emitting the observable signature with one of a LED and a controlled heat source, the one of the LED and controlled heat source providing the signature in one of photopic, scoptic, near IR, mid-wave IR and long-wave IR spectral regions.

16. The method of claim 10, the releasing the potential energy including urging the signature source assembly from a third position within the projectile outer shell to a fourth position beyond the projectile outer shell.

17. The method of claim 10, wherein in the first position the boat tail assembly covers an aperture of the projectile outer shell.

18. The method of claim 10, further comprising, before Step a) firing the projectile from a cartridge case assembly including a propellant propelling the projectile to the target.

19. A nonexplosive training munition, comprising:

a projectile configured to be propelled towards a target, the projectile having a projectile outer shell that has an aperture;

a cartridge case assembly including a cartridge case frictionally coupled to the projectile outer shell adjacent to the projectile outer shell aperture, the cartridge case assembly further including a propellant configured to propel the projectile to the target;

a signature source assembly attached to the projectile outer shell, the signature source assembly configured to illuminate an observable signature without an explosive signature;

a trigger assembly housed with the projectile outer shell and in communication with the signature source assembly to initiate an activation of the signature source assembly upon the projectile reaching the target;

a boat tail assembly that, in a first position, covers the projectile outer shell aperture and encloses the trigger assembly and signature source assembly within the projectile outer shell, wherein the boat tail assembly is urged by the trigger assembly during the initiation to a second position separate from the projectile outer shell to enable observable exposure of the observable signature; and a power source housed by the projectile outer shell, the power source providing electrical current to the signature source assembly for production of the observable signature, wherein the signature source assembly upon the activation produces the observable signature without a pyrophoric ignition.

* * * * *